United States Patent [19]
Sochor
[11] 4,275,944
[45] Jun. 30, 1981

[54] MINIATURE CONNECTOR RECEPTACLES EMPLOYING CONTACTS WITH BOWED TINES AND PARALLEL MOUNTING ARMS

[76] Inventor: Jerzy R. Sochor, 164 Rockview, Irvine, Calif. 92715

[21] Appl. No.: 55,731

[22] Filed: Jul. 9, 1979

[51] Int. Cl.[3] ..... H01R 13/62

[52] U.S. Cl. ..... 339/74 R; 339/64 M; 339/176 MP; 339/221 R

[58] Field of Search ..... 339/17 C, 17 M, 17 LC, 339/17 LM, 64 R, 64 M, 74, 176 MP, 221

[56] References Cited

U.S. PATENT DOCUMENTS

| | | | |
|---|---|---|---|
| 3,400,360 | 9/1968 | Schmitt et al. | 339/64 R |
| 3,444,504 | 5/1969 | Lynch et al. | 339/64 R |
| 3,596,235 | 7/1971 | Hendricklaan | 339/176 MP |
| 3,631,381 | 12/1971 | Pittman | 339/221 M |
| 3,732,531 | 5/1973 | Bouley | 339/176 MP |
| 4,066,327 | 1/1978 | Soes | 339/252 R |
| 4,075,759 | 2/1978 | Sochor | 339/176 M |

FOREIGN PATENT DOCUMENTS

| | | | |
|---|---|---|---|
| 2203513 | 8/1973 | Fed. Rep. of Germany | 339/176 MP |
| 2452402 | 5/1976 | Fed. Rep. of Germany | 339/176 MP |
| 1364127 | 5/1964 | France | 339/17 LC |

OTHER PUBLICATIONS

"Cam Activated Multicontact Connector"; IBM Technical Disclosure Bulletin, vol. 17, No. 5 Oct. 1974.

*Primary Examiner*—John McQuade
*Attorney, Agent, or Firm*—David Pressman

[57] ABSTRACT

Versatile card-edge or other types of connector receptacles comprise contacts with one or more bowed cantilevered primary contact arms (tines) 26 and one or more cantilevered parallel arms 28 for insulator mounting, both sets of arms extending in a common direction from a common body portion 24. The secondary contact arms (tails) of the contacts may extend from the bottom 44 (horizontally or vertically) or the sides of the contact 36. The mounting arms may have barbed or pointed retention surfaces 32 on either their inside or outside edges and the contacts may be installed into either the top or the bottom of an insulator housing 10. The bowed contact tines may have installation shoulders 34 extending over the top of the insulator housing to provide bearing surfaces for press-fit installation. The connectors may have a zero-insertion-force feature, whereby a spreading bar 78 may be inserted between the bowed tines 26 to pre-spread them for ease of male mating member insertion. The spreading bar 144 may have a long, gradual taper to provide superior mechanical advantage. Associated cam-follower members 142 may be interposed between the bar and the tines. Narrow versions of the contacts (for parallel-mounted connectors) can be effected by providing slitted 172 (rather than slotted) contact tines.

23 Claims, 16 Drawing Figures

MINIATURE CONNECTOR RECEPTACLES EMPLOYING CONTACTS WITH BOWED TINES AND PARALLEL MOUNTING ARMS

FIELD OF INVENTION

This invention relates generally to electrical connectors and particularly to high contact density connector receptacles which have superior mechanical and electrical advantages.

DESCRIPTION OF PRIOR ART

Heretofore printed circuit connector receptacles have been provided to receive the edge of a PC board (PCB) to interconnect the printed conductors at the edge of the PCB (or other electronic module) to a larger interconnection panel, chassis, or wiring board. Such receptacles are termed in the trade "one-piece connectors" because they mate directly with a functioning electronic element (i.e., the PCB), rather than a mating connector. Many such one-piece connectors are generally mounted close together in computers, airborne, and other equipment. It is thus desirable that one-piece or cardedge connectors have the highest possible contact mounting density so that the size and weight of the equipment—and also the lengths of the electrical interconnections between circuit components—are minimized.

Accordingly it is one object of the present invention to provide an edge or one-piece connector of a smaller size and higher contact density—yet superior mechanical and electrical characteristics—than heretofore available.

Another type of connector receptacle, termed in the trade the female half of a "two-piece connector", is used when it is desirable to establish a connector-to-connector mating interface in which one mating connector half (e.g., with blade contacts) is permanently soldered to a PC module board while the other, female, connector half (e.g., with tuning fork type receptacle contacts) is mounted on a wiring board or interconnection panel.

It is another object of the invention to provide high contact density two-piece connectors with better mechanical and electrical characteristics than heretofore available.

Generally, different contact types had to be used for one- and two-piece connectors due to incompatibility of size and mating configurations. Accordingly, it is another object of the invention to provide a single contact that can be employed in one and two-piece connectors, while also using a substantially similar insulator.

In the case of connectors with a large number of contacts (e.g., in excess of 100), direct insertion of a PC card or mating connector half may prove difficult because of the large number of contacts which must be spread during mating. This problem has been overcome by providing Zero Insertion Force (ZIF) connectors. These have means to pre-spread the female contacts in the receptacle prior to insertion of the PCB or mating connector half, so that the male contacts or PCB can be inserted with little or no force. Thereafter the female contacts may be released so that they will close upon and make normal contact with the male contacts or PCB.

Heretofore ZIF connectors have had numerous disadvantages. A ZIF connector was not generally interchangeable with a non-ZIF connector, so that separate tooling was required to manufacture a ZIF connector.

The ZIF actuating mechanism was not as reliable, precise, or as economical as would be desirable. Also ZIF mechanisms were not generally available for high contact density connectors (e.g., 1.27 mm spacing) since performance and electrical and mechanical characteristics had to be sacrificed in order to accomodate the ZIF feature. Accordingly it is still another object of the present invention to provide superior ZIF connectors.

Many other objects and advantages of the invention exist and these will become apparent from a consideration of the subsequent description and the accompanying drawings.

DRAWINGS

On Sheet I, FIG. 1A shows an end, sectional view of an edge connector with alternating side tails and with contacts which are installed from alternate directions.

FIG. 1B is a side view of the connector of FIG. 1A, taken in the direction indicated by the lines 1B—1B.

Also on Sheet I, FIG. 2A is an isometric projection, partially in section, of an edge connector with bottom tails which can be press fit into plated-through holes in a PCB.

On Sheet II, FIG. 2B is a sectional end view of the connector of FIG. 2A taken along the lines 2B–2B, with a showing of an inserted PCB.

Figure 5A:
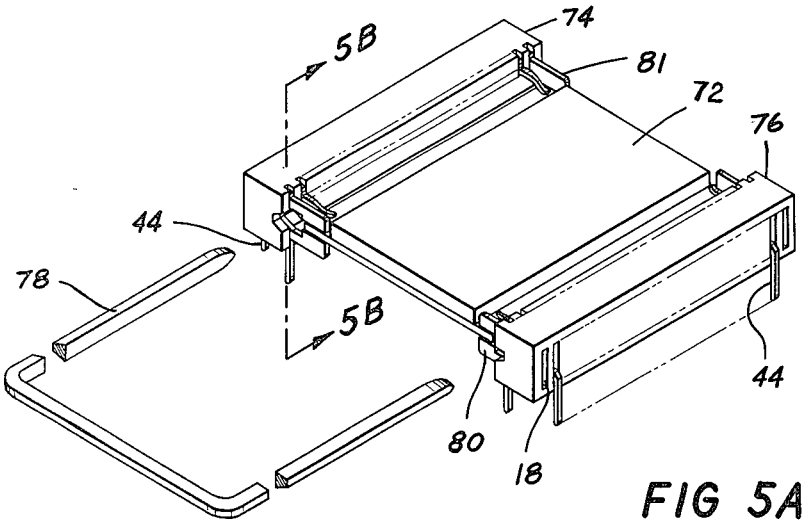

On Sheet III, FIG. 5A is an isometric projection of a pair of facing edge connectors designed to be mounted on a motherboard with an electrical component mounted in the connectors and also showing a ZIF actuator.

Figure 5B:
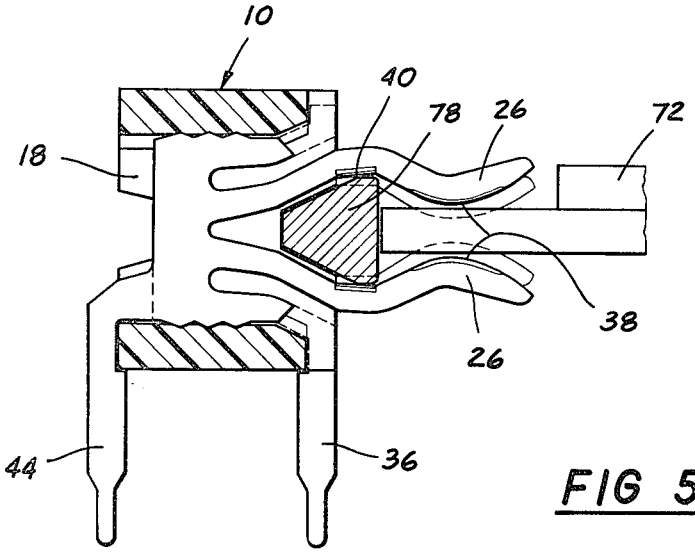

FIG. 5B is an end sectional view of one of the connectors of FIG. 5A taken along the lines 5B—5B.

Figure 6:
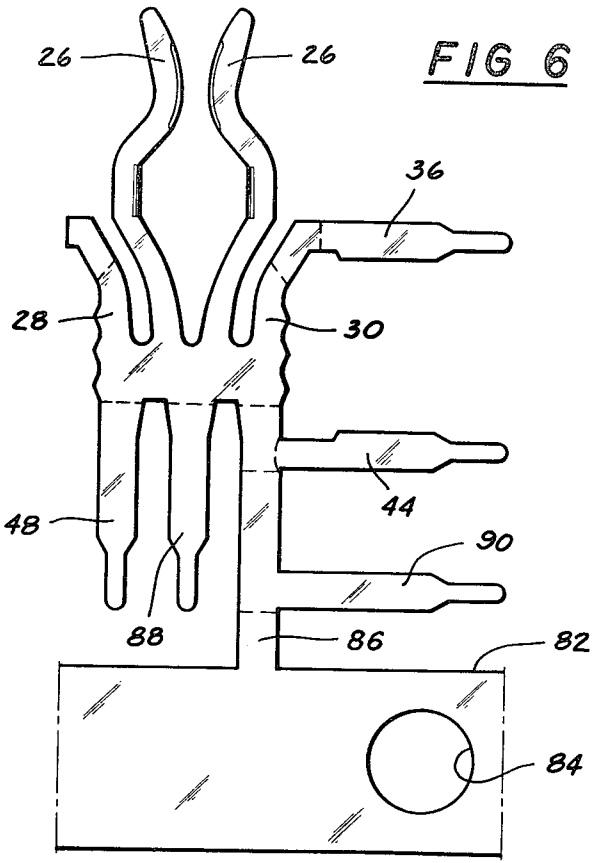

On Sheet IV, FIG. 6 is a plan view of a universal contact blank and its associated carrier strip.

Figure 7:
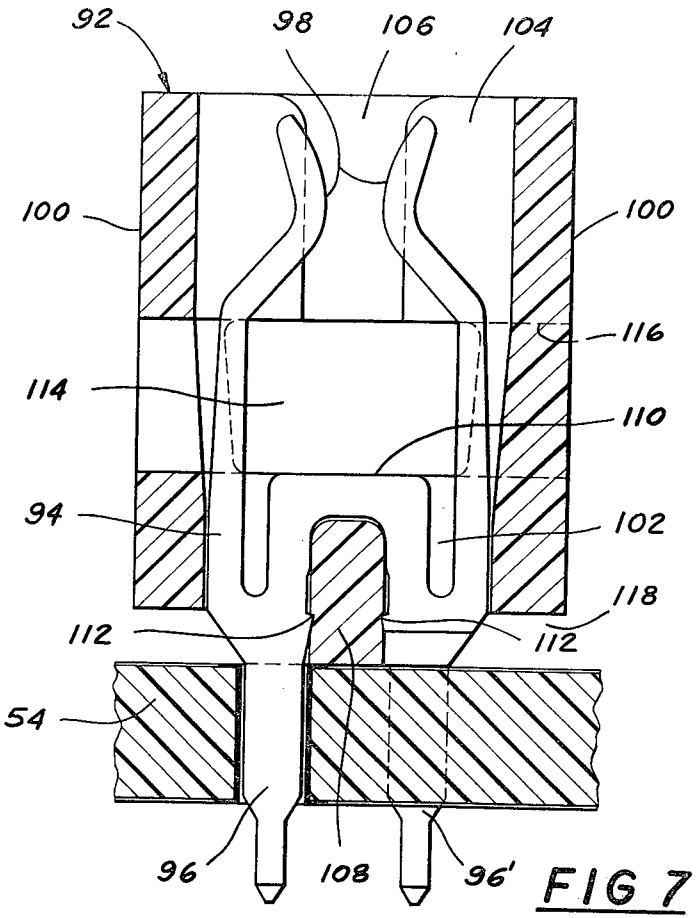

FIG. 7 is a sectional end view of a ZIF edge connector with alternatingly-positioned contact tails which may be installed by press-fit on a PC motherboard and which has bottom side recesses for easy removal from the PCB.

Figure 8A:
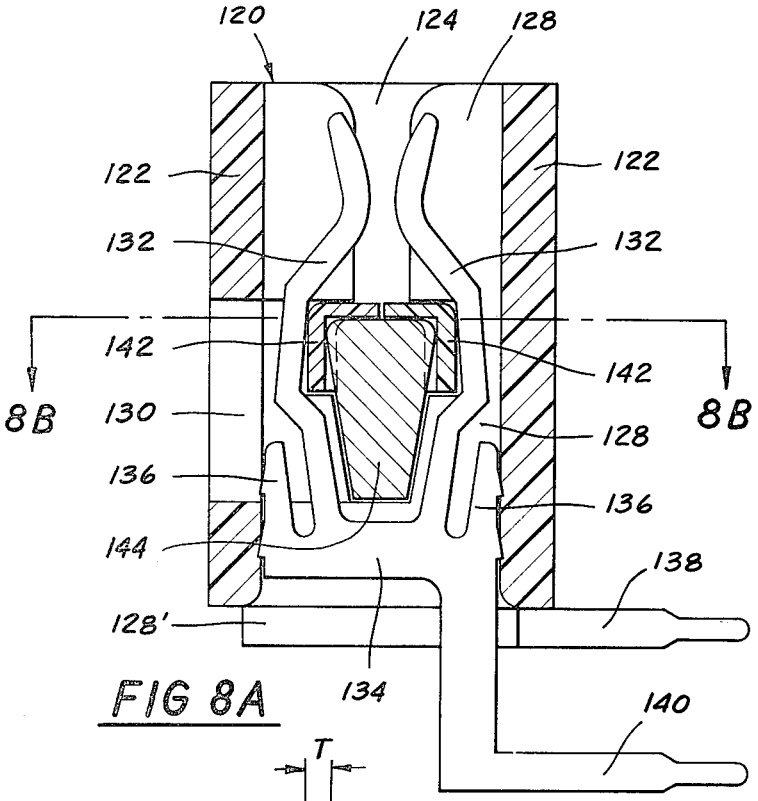

On Sheet V, FIG. 8A is an end sectional view of an edge ZIF connector with bottom horizontal tails which are alternatingly positioned and wherein the contacts can be installed from the bottom of the insulator housing. The connector of FIG. 8B also utilizes a single ramp ZIF actuating mechanism.

Figure 8B:
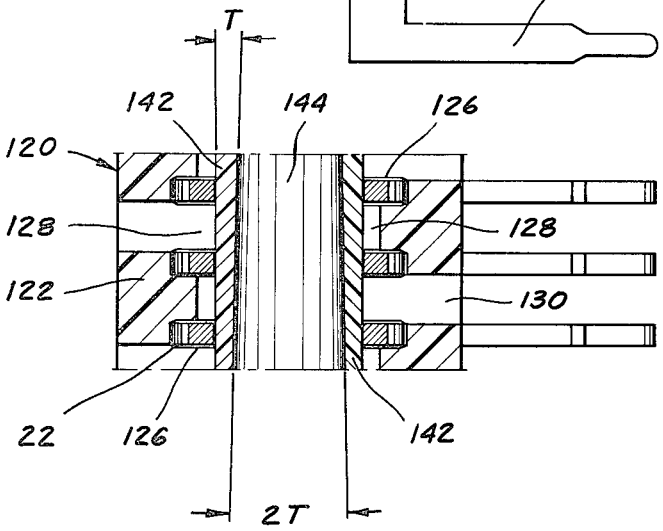

FIG. 8B is a sectional view of the connector of FIG. 8A taken along the lines 8B—8B.

Figure 9:
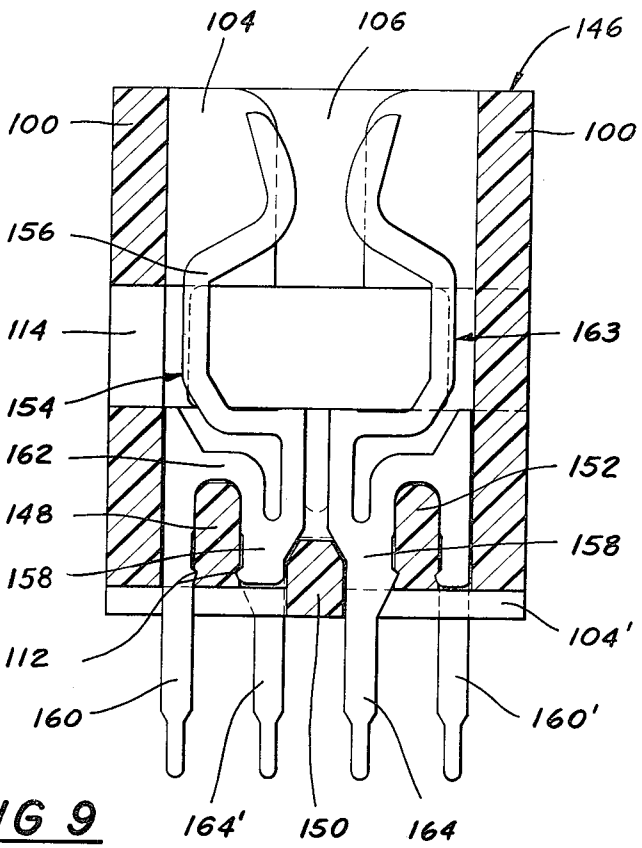

On Sheet VI, FIG. 9 is an end sectional view of a ZIF edge connector which is designed to mate with a PCB having circuits on both sides thereof.

Figure 10:
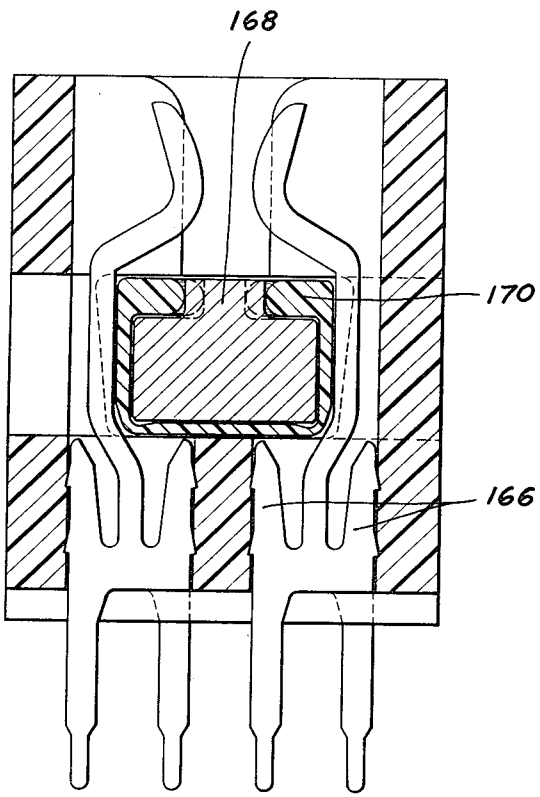

FIG. 10 is an end sectional view of a similar type of connector which utilizes an interposed cam follower member for the ZIF actuator and wherein the contacts have outside retention barbs, rather than inside barbs as in FIG. 9.

Figure 11:
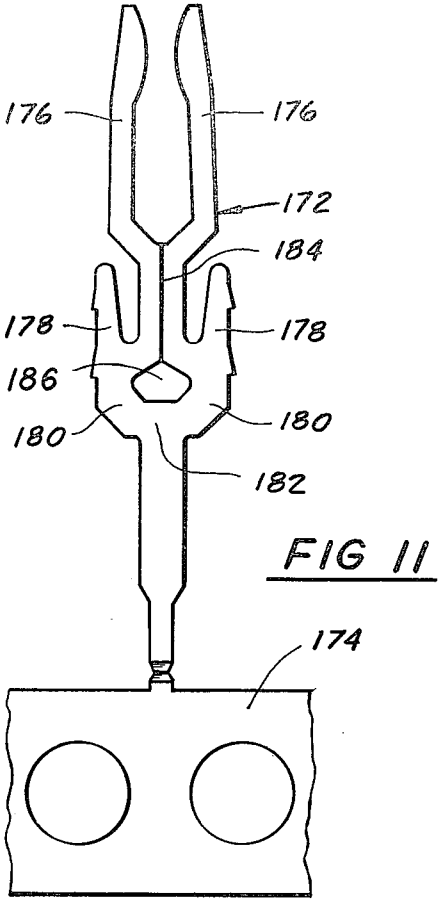

On Sheet VII, FIG. 11 is a plan view of a very narrow (slitted) contact on a carrier strip.

Figure 12:
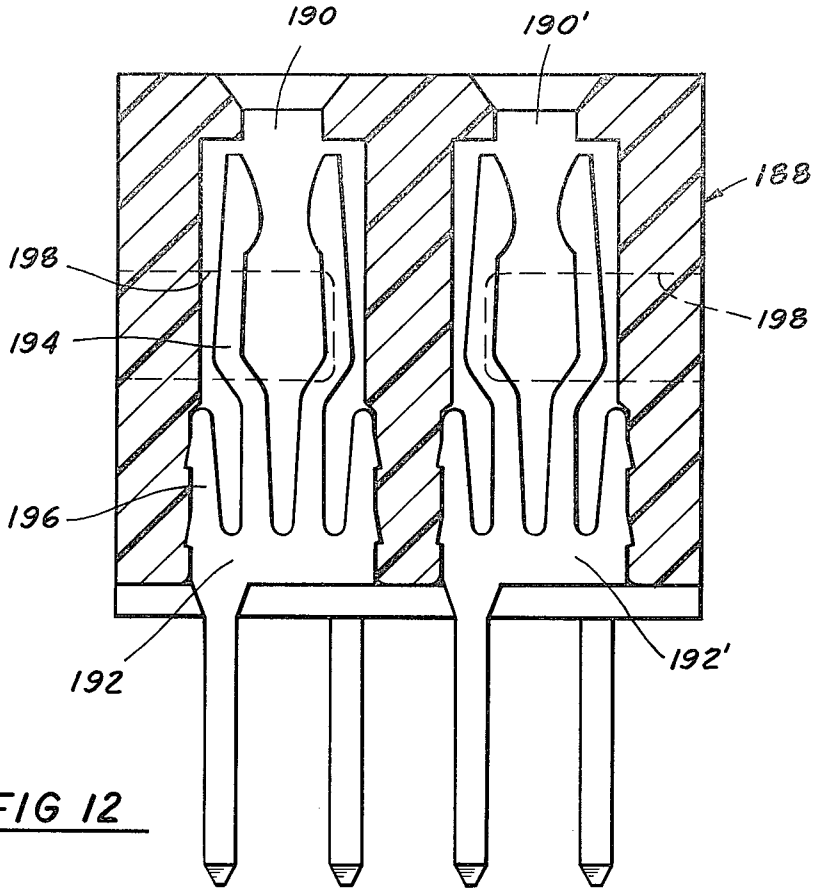

FIG. 12 is an end sectional view of a two-piece connector receptacle with two rows of contacts.

REFERENCE NUMERALS

| | | |
|---|---|---|
| 10 insulator | 12 contact | 14 contact |
| 16 slot | 18 contact recess | 20 space |
| 22 corner chamfer | 24 contact body | 26 tines |
| 28 mounting arm | 30 mounting arm | 32 retaining edge |
| 34 ear of arm | 36 tail | 38 mating surface |
| 40 coined area | 42 edge of arm | 44 tail |
| 46 partition | 48 tail | 50 end guide |
| 52 tabs | 54 motherboard | 56 plated hole |
| 58 PCB | 60 tails | 62 solder |
| 64 motherboard | 66 hole | 68 motherboard |
| 70 tails | 72 electronic device | 74 ZIF connector |
| 76 ZIF connector | 78 ZIF actuator | 80 slotted end guide |
| 81 solid end guide | 82 carrier strip | 84 hole |
| 86 web | 88 bottom tail | 90 bottom tail |
| 92 housing | 94 contact | 96 bottom tail |
| 98 tines | 100 sidewalls | 102 web |
| 104 partition | 106 slot | 108 bar |
| 110 saddle portion | 112 barbs | 114 recess |
| 116 next recess | 118 space | 120 insulator |
| 122 sidewalls | 124 slot | 126 contact recess |
| 128 partition | 130 recess | 132 tines |
| 134 body portion | 136 mounting arms | 138 close tail |
| 140 spaced tail | 142 interposer | 144 ZIF actuator |
| 146 insulator | 148 outer bar | 150 inner bar |
| 152 outer bar | 154 left contact | 156 bowed tine |
| 158 body portion | 160 tail | 162 bight portion |
| 163 right contact | 164 tail | 166 mounting arm |
| 168 actuating bar | 170 interposer | 172 contact |
| 174 carrier strip | 176 tine | 178 mounting arm |
| 180 common leg | 182 body | 184 slit |
| 186 opening | 188 housing | 190 aperture |
| 192 contact | 194 tines | 196 mounting arms |
| 198 recess | | |

FIGS. 1A AND 1B

Figure 1B:
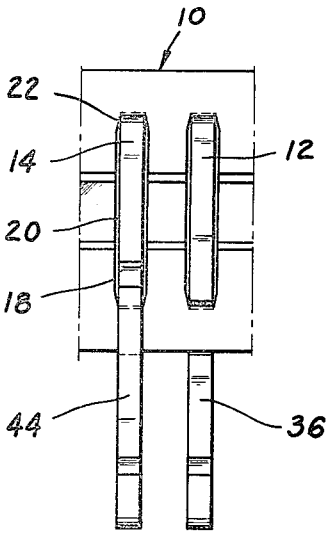
Figure 1A:
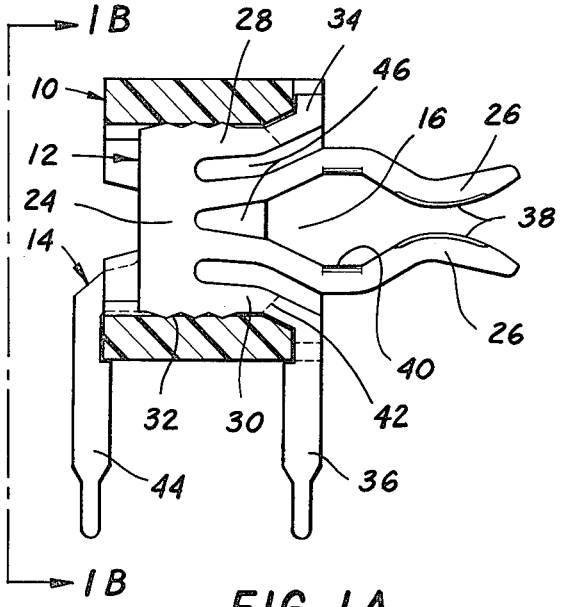

The connector shown in FIGS. 1A and 1B comprises an insulator housing having a row of contacts mounted therein. For ease of illustration, only a short section of insulator 10 with two contacts, 12 and 14, is shown.

Insulator 10 comprises an elongated strip having a slot 16 along the length thereof, with contact receiving recesses, such as 18, communicating with, but oriented at right angles to, slot 16. Each contact recess 18 is slightly wider than its contact so that a slight space 20 is left to allow each contact to flex without rubbing against the walls of slot 18. Each recess has chamfered corner surfaces, such as 22, which abut the corner edges of the contact and thereby center the contact between the walls of the recess.

Contact 12 comprises a body portion 24 from which extend two elongated cantilevered contact arms or tines 26 and two cantilevered mounting arms 28 and 30 which extend in the same direction as tines 26 and which sandwich tines 26. Both mounting arms have retaining edges, such as 32, with points thereon for engaging and holding the contact by interference fit against the inner surfaces of the outer walls of insulator 10.

The right hand end of mounting arm 28 is angled or bent upwardly to provide an ear 34 which rests against a right hand edge of the outer wall of insulator 10. The right hand end of mounting arm 30 is curved or bent downwardly and extends to form a secondary contact portion or tail 36 which is designed to be mounted into a printed circuit board (not shown).

Each tine 26 has a convex mating surface, such as 38, which is designed to receive, guide, and make contact with a PCB (not shown) when inserted from the right to the left between tines 26 and into groove 16. Tines 26 are bowed outwardly in the middle portion thereof and the inside edge thereof is coined at 40 so that a Zero Insertion Force (ZIF) actuator bar (not shown) may be easily inserted between tines 26 to spread them, if necessary.

The bowed arrangement of tines 26 allows tines 26 to accomodate PCBs of different thicknesses, allows a thicker and thus more rigid ZIF actuator bar to be inserted between the tines, and provides a nest which holds such ZIF actuator bar in precise position. In addition the bowed arrangement of the tines provides a longer beam length between mating surface 38 and contact body 24. As will be recognized, such tine configuration will provide superior spring parameters in a smaller connector envelope. Lastly, the bowed arrangement of the contact tines provides a shape which limits outward spreading of the tines because if an overstress condition is encountered, the outer edges of the bowed portions of the tines will contact the adjacent edges of mounting arms 28 and 30, or optional coined projections thereon (not shown), before damage to the contacts can occur.

As will be apparent, contacts 12 and 14 can be used for both ZIF and non-ZIF applications.

Contact 12 is assembled ("loaded") into insulator 10 from the right to the left and is held by friction fit between retaining edge 32 and insulator 10. Contact 14, on the other hand, is inserted from the left and, though not shown in full view in either figure, is similar to contact 12 except that its mounting arms terminate at edges indicated by broken lines 42, so that contacts similar to 14 can be inserted from the left. Contact 14 also differs from contact 12 in that its tail portion 44 extends to the left from the body of contact 14 and then downwardly. Thus although contacts slots 18 of insulator 10 are identical, each adjacent slot is loaded with alternate types contacts (12 and 14) so that the positions of the contact tails alternate from left to right (FIG. 1A) as indicated at 36, 44. This enables the tail spacing to be optimized, thereby providing more reliable electronic equipment.

In insulator 10, each contact is separated from its adjacent contact by an integral partition 46 which also provides a stop for the edge of the PCB (not shown) when inserted between tines 26.

Exemplary dimensions and materials are as follows: insulator 10 may be about 5.0 mm high and 3.5 mm wide (FIG. 1A) and may be molded from thermoplastic polyester, nylon, or diallyl phthallate. Contacts 12 and 14 may be about 0.4 mm thick and 1.27 mm apart and may be stamped from a phosphor-bronze or beryllium-copper strip. Other dimensions can be taken proportionally from the scale shown.

In use, the connector is mounted onto a motherboard by inserting contact tails, such as 36, 44, through holes in the motherboard and soldering such tails to printed circuit conductors on the underside of the motherboard. Alternatively, such tails can be inserted by force fit into plated-through holes on the motherboard and the extending portions of the tails on the underside of the motherboard can be interconnected by wire wrapping. Individual smaller printed circuit cards or circuit components (such as shown in FIG. 5A) then can be inserted between tines 26, parallel to the motherboard.

FIGS. 2A AND 2B

Figure 2A:
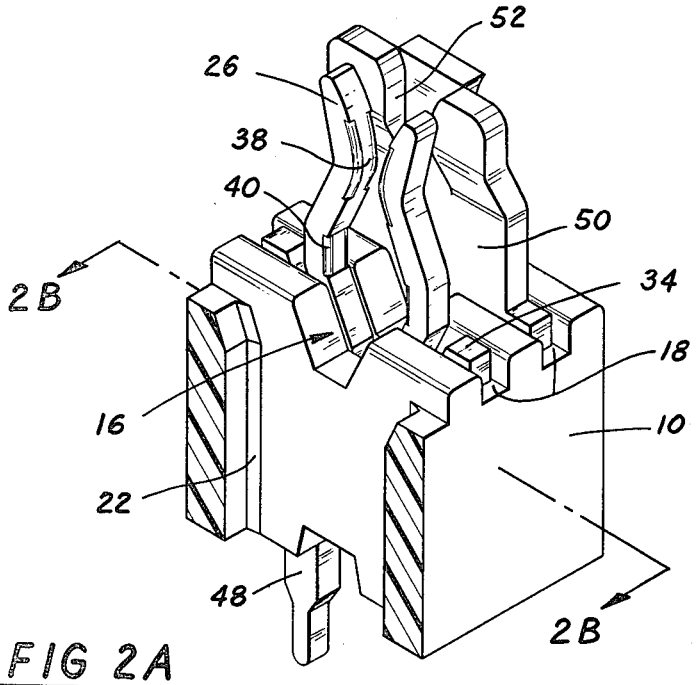
Figure 2B:
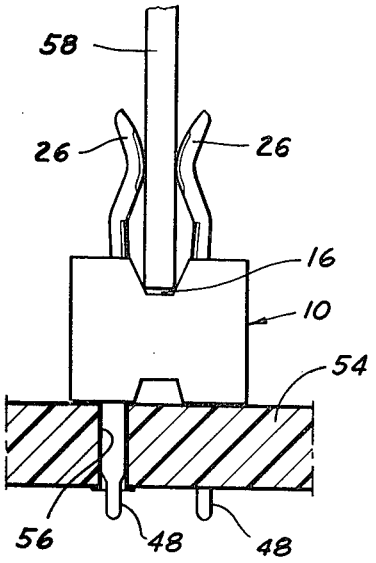

The connector shown in FIGS. 2A and 2B is similar to that of FIG. 1 except that the contact tails extend to the bottom, in the opposite direction from the contact tines, so that when the connector is mounted on the motherboard, the contact tines will extend upwardly, perpendicular to the motherboard, and the circuit cards will also be mounted perpendicularly to the motherboard.

Insulator 10 is identical to that of FIG. 1, as are contact tines 26. Contact tail 48 is similar to tails 36 and 44 of FIG. 1, except that this tail extends from body portion 24 of the contact in a direction opposite to that of tines 26. All of the contacts are identical and the adjacent contacts are rotated 180° so that tails 48 extend from alternate sides of slot 16, as indicated in FIG. 2B. All of the contacts have mounting arms identical to mounting arm 28 of FIG. 1A; i.e., the mounting arm is bent over and terminated to provide an ear 34 which rests against the upper surface of insulator 10 as indicated in FIG. 2A.

Metal end guides, such as 50, are inserted in the last recess 18 at each end of the connector to aid in correctly aligning the mating panel. Tabs 52 are formed by two vertical shear cuts from the upper edge of guide 50; tabs 52 are bent inwardly to form a slot with an end stop to align the panel longitudinally and restrict lateral movement, in cooperation with tines 26. Other ways of aligning the panel, such as providing a keying slot on the panel and a key on the connector, are known to those skilled in the art.

The contacts are loaded into the insulator from the top until ears 34 rest against the upper surface of recess 18.

FIG. 2B shows the connector mounted on a motherboard 54. The connector is attached to the motherboard by pushing the square or rectangular contact tails into plated-through circular or rounded holes, such as 56, in the motherboard where they are retained by force fit. The tips of the contact tails may be interconnected by wire wrapping or other known methods. A slotted tool (not shown) may be used to push against the outer edges of ears 34 of the mounting arms, which are flush with the upper surface of insulator 10, to effect such installation. A mating panel, such as PCB 58, can be plugged into the connector, before or after the installation of the connector on a motherboard.

FIG. 3

Figure 3:
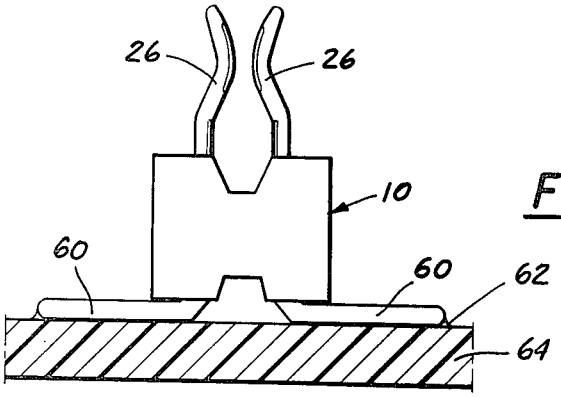
FIG. 3 is an end view, partially in section, of an edge connector with bottom horizontal tails which are soldered to a substrate.

The connector of FIG. 3 is similar to that of the previous figures except that its contact tails 60 extend from the bottom side of housing 10 in directions perpendicular to tines 26. Tails 60 are similar to tail 44 of FIG. 1A except that tails 60 are uniform in thickness and are not stepped, as is tail 44, so that they can be attached by means of solder 62 to circuit conductors (not shown) on mother board 64.

FIG. 4

Figure 4:
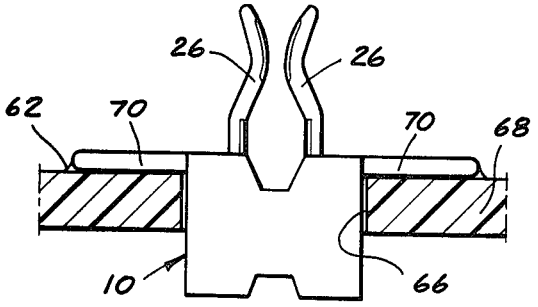
FIG. 4 is an end view, partially in section, of an edge connector with side horizontal tails which are soldered to the substrate and wherein the connector body is actually mounted in the substrate.

In the connector of FIG. 4, insulator housing 10 is actually mounted within a large cut-out hole 66 in motherboard 68 and the contact tails 70 extend from the sides of the insulator, adjacent the upper surface thereof, in a direction perpendicular to the direction in which contact tines 26 extend. Tails 70 are soldered at 62 to the upper surface of board 68.

The arrangement of FIG. 4 occupies substantially less height than that of FIG. 3, at some sacrifice in utilization space on motherboard 68.

FIGS. 5A AND 5B

FIG. 5A illustrates how the connector of FIGS. 1A and 1B can be used as a ZIF (Zero Insertion Force) connector. An electronic device 72, which may be an integrated circuit on a substrate, is shown plugged into two connectors 74 and 76. Connectors 74 and 76 are mounted on a motherboard (not shown) by means of their tails, such as 44, which are inserted through holes in the motherboard and are attached to the motherboard, either by press-fit or by soldering to the underside of the motherboard.

To aid in plugging device 72 into connectors 74 and 76, a ZIF actuator 78 is provided. Actuator 78 is a U-shaped bar of insulation-covered metal, which has tapered tips for ease of insertion. Actuator 78 can be made of non-covered metal, but an insulating surface is preferred to avoid shorting live contacts.

As shown in FIG. 5B, when actuator 78 is inserted between tines 26 of the contacts, it bears against coined edges 40 on the inside of the bow-shaped portions and spreads tines 26, as indicated by the solid lines, so that the space between the convex mating portions 38 of tines 26 will become greater than the thickness of the substrate of device 72. Device 72 thus can be inserted between tines 26 with no effort. When actuator 78 and the PCB are removed, tines 26 will close together upon device 72 to make a good electrical contact therewith. In practice, actuator 78 and device 72 may be inserted simultaneously from one side (with the tapered tips of actuator 78 leading slightly), or actuator 78 may be inserted first from one side to spread tines 26, whereafter device 72 may be inserted from the other side between the spread tines.

End guides, such as 80 (slotted) and 81 (solid) may be provided to hold and align device 72 so that the tines will make proper contact with the proper respective circuit conductors (not shown) on the substrate.

FIG. 6

A universal contact and carrier strip (FIG. 6) may be fabricated from a blank strip of sheet metal (not shown) having a width equal to the total horizontal dimension of the configuration of FIG. 6. Thereafter successive stamping and coining operations well known in the art are effected to provide the contact strip having the configuration shown. The contact strip has a carrier portion 82 with holes, such as 84, for indexing and enabling the strip to be moved to successive stamping and coining stations. The contact is attached to strip 82 by a web 86. The contact has tines 26, a mounting arm 28, an opposite mounting arm 30 with an attached tail 36, two bottom tails 44 and 48, and two further bottom tails 88 and 90 which may be used when embodiments such as that shown in FIG. 8A are desired. At the next stamping station the assembly shown in FIG. 6 is further trimmed on the broken lines indicated to eliminate those tails which are not desired. A contact strip such as 82 with a plurality of web-joined contacts (not shown) may be assembled into an insulator housing, whereafter strip 82 may be broken off, as described in FIG. 18 of my patent 4,075,759, Feb. 28, 1978.

FIG. 7

The connector shown in FIG. 7 comprises an insulating housing 92 containing a contact 94 which has a bottom tail 96 extending in a direction opposite to that of contact tines 98. Adjacent contacts are rotated 180° so that the tail 96' of the next contact is positioned in a different row from that of tail 96. Housing 92 comprises sidewalls 100 which are interconnected at their bases by a web portion 102 which extends up to the top of walls 100 to form a partial partition 104. Partition 104 has a PCB slot 106. Slot 106 can be eliminated—i.e., partition 104 can be made solid—if insulator 92 is part of a two piece connector intended to mate with a single row of individual blades. Aligned at right angles to slot 106 are contact receiving recesses (not shown), which are similar to recesses 18 of FIG. 1B and FIG. 5A. These recesses extend completely through insulator housing 92 from top to bottom except for a bar 108 which runs along the full length of the bottom of the insulator and which extends below the bottoms of walls 100. Bar 108 is integrally connected to side walls 100 by webs 102.

The two tines 98 of contact 94 are interconnected by a saddle portion 110 which contains inner barbs 112 so that when saddle portion 110 is mounted around bar 108, barbs 112 will engage and hold the contact to bar 108. Each partition 104 also contains a recess 114 in order to enable a ZIF actuating bar (not shown) to be inserted between tines 98. Recess 114 extends through one wall 100 in order to facilitate molding of housing 92. In order to maintain both walls 100 of approximately equal strength, recesses 114 extend from opposite walls 100 for alternate partitions 104, as indicated by broken line 116 which represents the next recess behind recess 114.

When the connector of FIG. 7 is mounted on a motherboard 54, bar portion 108 of insulator 92 will sit on the motherboard 54 so that the bottom surfaces of walls 100 will be held away from motherboard 54 to provide space 118 so that a footed tool (not shown) may be inserted under wall 100 to aid in removing the connectors from the motherboard. The connector may be installed in the motherboard by force-fit or by soldering, in conventional fashion. Note that the length of the cantilevered beam of each of tines 98 is substantially as long as the full height of the connector, from the base to the top of walls 100. The tines thus have a relatively long beam length, whereby desirable mechanical and electrical properties are effected in a small connector envelope.

Since the contact is attached to insulator 92 by gripping an internal bar 108 thereof, no strain is placed on outer walls 100.

FIGS. 8A AND 8B

The edge connector of FIGS. 8A and 8B is designed for mounting on a motherboard and receiving and making a connection with the edge of a circuit card or device which is mounted in parallel to the motherboard, similar to the arrangement shown in FIG. 5A. The connector of FIGS. 8A and 8B employs completely enclosed contact tines and a unique ZIF mechanism.

The connector has an insulator 120 with sidewalls 122, a longitudinal slot 124, and contact recesses 126 which are oriented perpendicularly to and which intersect slot 124. (As in FIG. 7, slot 124 in partition 128 can be eliminated if the connector is to mate with individual male blades.) Recesses 126 have chamfered corners, such as 22, similar to that of FIG. 1B, in order to center each contact in its recess. Contact recesses 126 are separated by partitions 128, which have recesses such as 130 to accomodate a ZIF actuator. Adjacent ZIF recesses 130 of partitions 128 are positioned on alternating sides of housing 120, as indicated in FIG. 8B. Lower portion 128' of partition 128 has a reduced thickness to allow solder flux cleaning fluid to flow readily around tail 138.

The contacts have bowed tines 132 which are cantilevered from a body portion 134 and which are sandwiched between a pair of mounting arms 136. Arms 136 have outer retaining edges to hold the contacts firmly against the inside surfaces of outer walls 122. Each contact has a tail which extends horizontally from the bottom of the connector, either close to the connector (tail 138) or spaced therefrom (tail 140) with the tails of adjacent contacts having alternating spacings so that the spacings between the tails will be optimized.

A pair of insulating interposers (cam followers) 142, each having a channel shape, is positioned between the bowed portion of tines 132; these interposers 142 may be made of nylon and are not attached to any other members but are held in place within recesses 130 of partitions 128 and within the nest created by the bowed portions of tines 132.

As indicated best in FIG. 8B, the thickness of the vertical side of each interposer 142 gradually increases along the length of the connector at a taper angle T. The outer surfaces of each vertical side of the interposers are parallel to each other and to walls 122 of insulator 120, while the inner surfaces of the vertical sides taper together at an angle 2T, as indicated.

A ZIF actuator bar 144, which may be of metal or reinforced plastic, has an inverted trapezoidal shape, is shown positioned between interposers 142 such that tines 132 will be spread apart to receive a mating member (not shown) without insertion effort. Bar 144 tapers gradually along its length at an included angle 2T, as indicated in FIG. 8B. The slope resulting from taper angle T preferably is about 1% (1 mm per 10 cm) thus providing a good mechanical wedge advantage.

In order to spread the contacts for insertion or removal of the male mating member (PCB or blades—not shown) bar 144 is inserted in the direction of viewing in FIG. 8A (bottom on top in FIG. 8B). For a given slope, the length of the actuating stroke is determined by the distance the interposers must be spread to effect a desirable contact opening. The sloped surfaces of interposers 142 and bar 144 remain in intimate contact on their full length after insertion, thereby insuring consistent contact opening due to uniform displacement of tines 132 and permitting relatively narrow interposers since the continuous support eliminates undesirable flexural stresses.

Actuator 144 may be permanently assembled in the connector or may be removable so that it will be present only during the actuating cycle, similar to the arrangement of FIG. 5A.

FIG. 9

The edge connector of FIG. 9 can provide electrically independent contacts to the opposite sides of a PCB when necessary, i.e., in the case of PCBs which have separate circuit conductors on opposite sides thereof. The connector comprises an insulating housing 146 which is similar to insulator 92 of FIG. 7 except that it has three longitudinal bars 148, 150, and 152 integrally molded along the bottom thereof. The usual longitudinal slot 106 and partitions 104 are provided to separate adjacent contacts. Partitions 104 have a reduced thickness bottom portion 104'. Alternating side recesses such as 114 are also provided to accomodate a ZIF actuator bar (not shown) and to aid molding of the housing. Each transverse contact recess (not indicated) contains two separate contacts: one for each side of the PCB. The left contact shown, 154, has a bowed tine 156 which is cantilevered from a body portion 158. A tail 160 is attached to body portion 158 by a bight portion 162 which saddles bar 148 of insulator 146. The contact grips the lower portion of bar 148 by means of points or barbs 112. Right contact 163 is similar to left contact 154 except that its tail 164 is attached directly to body portion 158.

As indicated, the next contact position behind contacts 154 and 163 contains two identical contacts, except that their positions are reversed and the contacts are rotated 180° so that the tail positions may be staggered as indicated by tails 160' and 164', which are behind bottom partition 104'.

The contacts of FIG. 9 can be operated with an actuating bar (not shown) in the same way as the other ZIF connectors.

FIG. 10

The connector of FIG. 10 is similar in function to that of FIG. 9 but differs therefrom in that the contacts are each mounted by means of a pair of mounting arms 166 which sandwich the contact's single tine. Also an actuating bar 168, having a rectangular base topped by a smaller rectangular head portion which is sloped along the connector, is provided in association with a one-piece flexible plastic interposer 170 with widened upper horizontal end portions, which are sloped conformally to the actuating bar, as in FIGS. 8A and 8B.

The contacts are held against the outer walls of the insulator (rather than inner bar portions of the insulator as in FIG. 9). Also the use of interposer 170 insulates actuating bar 168 from the contacts and provides a continuous bearing surface during insertion or actuation of bar 168.

FIG. 11

FIG. 11 shows a contact 172 attached to its carrier strip 174. Contact 172 has a very narrow dimension in the plane of the paper and thus can be mounted in a narrower version of insulator 10 of FIG. 1A or insulator 188 of FIG. 12.

Contact 172 has a pair of bowed tines 176 which are partially sandwiched by a pair of parallel mounting arms 178. Each tine 176 and its associated mounting arm 178 extends from a common leg 180, the proximal portions of which extend from a common body portion 182.

In their unmated condition, the lower sections of tines 176 are separated by a slit 184 which widens to a narrow slot (not indicated) when a PCB or a blade contact (not shown) is inserted between tines 176. Slit 182 communicates with a relief opening 186 between common legs 180. By reason of the use of a slit 184 (rather than a slot), the contact is made narrower so as to be useful where connectors are to be mounted in a closely spaced parallel relation.

FIG. 12

FIG. 12 shows a dual receptacle connector for receiving two rows of blades of a mating connector. The connector comprises a common insulator housing 188 with two rows of apertures 190 and 190' for receiving two respective rows of blade contacts. Each of apertures 190 and 190' have a tapered lead in chamfer. At each contact position a pair of identical contacts 192 and 192' are mounted in the same plane. Each contact comprises a pair of tines 194 sandwiched by a pair of mounting arms 196. Tines 194 are bowed and have convex mating surfaces but are spaced narrower than those of FIG. 1A in order to enable the contact rows to be spaced closely in parallel. Similar two-piece connector receptacles can be constructed in accordance with previous embodiments (e.g., FIGS. 8A and 8B), with recesses similar to 198 if it is desired to accommodate a ZIF mechanism.

While the invention has been described specifically, it will be appreciated that many variations are possible within the scope of the invention. For example many other materials, dimensions, and contact and insulator shapes are possible. Also the features of the various embodiments can be combined to produce arrangements other than those indicated. Therefore, the specificities of the foregoing description should be considered exemplary and the actual scope of the invention should be determined by the appended claims and their legal equivalents.

I claim:

1. A contact of the type comprising a metal member having at least one elongated tine for making a primary contact, characterized in that said tine is cantilevered from a body portion of said contact, extends generally in a given direction from said body portion, has a convex mating surface facing in a direction perpendicular to said given direction, is springy and is able to flex in a plane aligned in said direction perpendicular to said given direction, and has a center portion thereof which is bowed away from a line aligned in said given direction, said contact including a mounting arm also extending from said body portion in said given direction for at least the initial portion thereof, said mounting arm being separated from said tine by a bifurcating slot, said mounting arm also being springy and having a retaining edge facing in said direction perpendicular to said given direction, said retaining edge having at least one corner thereon for engaging the wall of an insulator housing, at least a portion of said mounting arm being positioned (a) under at least a portion of said tine, when viewed in a direction opposite to said given direction, and (b) in the same height area, measured in said given direction, as the portion of said tine adjacent said body portion of said contact and between said center portion of said tine and said body portion of said contact, whereby the dimensions of said contact in said given direction and in said direction perpendicular to said given direction will be minimized and the beam length of said tine will be optimized.

2. The contact of claim 1 wherein the end of said mounting arm distal from said body portion includes an end segment extending in a direction generally perpendicular to said given direction, whereby an installation shoulder for press-fit installation will be provided.

3. The contact of claim 1 further including an insulator housing comprising a body of insulating material having a recess therein, said recess having at least one side wall, the body portion of said contact being positioned in said recess, said corner of said retaining edge of said mounting arm of said contact forcibly pressing against said side wall to aid in holding said contact in said recess, said recess of said insulator housing including a top surface adjoining said side wall of said recess and oriented generally perpendicular thereto, an end segment of said mounting arm positioned adjacent said top surface of said insulator housing.

4. The contact of claim 1 further including an elongated integral tail portion for making a secondary contact, said tail portion extending in a direction away from said given direction.

5. The contact of claim 4 wherein said tail portion is an extension of said mounting arm and is joined to an end of said mounting arm at an angle.

6. The contact of claim 4 wherein said tail portion extends from said body portion.

7. The contact of claim 1 wherein two elongated tines are cantilevered from said body portion of said contact, extend generally in said given direction from said one side of said body portion, said tines each having a convex mating surface which faces the convex mating surface of the other tine and in a direction perpendicular to said given direction, said tines both being springy and able to flex in a plane aligned in said direction perpendicular to said given direction, a center portion of each of said tines both being bowed away from the opposite tine and aligned in said given direction, said contact also including two mounting arms extending from said body portion in said given direction and on said one side of said body portion, each of said mounting arms being generally uniformly separated from a respective one of said tines by a generally uniform bifurcating slot, said mounting arms also being springy and each having a retaining edge facing in a direction perpendicular to said given direction and away from the retaining edge of the other mounting arm, each of said retaining edges having at least one corner thereon for engaging the wall of an insulator housing.

8. The contact of claim 7 wherein said two tines and said two mounting arms which extend from said one side of said body portion are arranged so that said mounting arms sandwich said tines.

9. The contact of claim 8 wherein said contact is in stamped blank form and includes at least four elongated integral tail portions, each for making a secondary contact, each extending away from said given direction, at least one of said tail portions extending from said mounting arm and at least two more of said tail portions extending from said body portion in a direction opposite to said given direction.

10. The invention of claim 7 further including an insulating housing comprising an elongated body of insulating material having a plurality of recesses therein, each recess having a contact similar to that described mounted therein, said contacts being arranged in a row aligned in a direction normal to said given direction and to said direction perpendicular to said given direction such that the facing bowed portions of the tines of said given contacts define an elongated opening between said tines, and further so that when a spreading bar having a predetermined thickness and shape is fully inserted into said elongated opening between said tines, said bar will cam the bowed portions and spread the bowed and mating portions of the pair of tines of every contact by a predetermined amount such that a male mating member may be inserted between said mating portions with less force when said spreading bar is not fully inserted.

11. The invention of claim 10 further including means for receiving a spreading bar which has a gradual thickness taper along the length thereof.

12. The invention of claim 11 wherein such means for receiving a spreading bar comprises elongated interposer means positioned between the bowed portions of said contact and arranged to act as a cam follower so that said spreading bar will slide against said interposer means when inserted and said interposer means will thereby in turn force said bowed portions apart.

13. The invention of claim 12 wherein said elongated interposer means has a gradual taper equal to one half the taper angle of said spreading bar.

14. The contact of claim 1 wherein said metal member is a substantially flat sheet metal member which lies essentially in a single plane.

15. The contact of claim 14 further including an insulator housing comprising a body of insulating material having a recess therein, said recess being substantially flat, but wider than the thickness of said sheet metal member, said recess having two generally parallel, opposing major side walls and two generally parallel, opposing minor side walls, said corner of said retaining edge of said mounting arm of said contact, forcibly pressing against one of said minor side walls, each of said side walls being joined to its adjacent walls by a beveled wall section, said sheet metal member having edes which contact said beveled section such that the major faces of said sheet metal member tend to be separated from the adjacent major side walls of said recess.

16. The contact of claim 1 further including an insulator housing comprising a body of insulating material having a recess therein, said recess having at least one side wall, the body portion of said contact being positioned in said recess, the corner of said retaining edge of said mounting arm of said contact forcibly pressing against said side wall to aid in holding said contact in said recess.

17. The contact of claim 1 wherein said mounting arm includes two generally parallel portions joined by a bight portion, the first of said two generally parallel portions extending from said body portion and parallel to at least a first portion of said tine, the second portion of said two generally parallel portions spaced from said first portion by a bifurcating slot, said contact having an elongated integral tail portion extending in a direction opposite to said given direction from one of said body portion of said contact and said second portion of said mounting arm.

18. The contact of claim 17 further including an insulator housing having a recess in which said contact is mounted, said recess having a bar therein, said bifurcating slot between said parallel portions mounted around and forcibly clamped to said bar.

19. The assembly of claim 18 wherein a pluralty of contacts are mounted in said insulator housing and are arranged in two rows in said housing, each contact mounted in a respective recess, the convex mating surfaces of the contacts of one row being aligned and facing those of the other row, the positions of the tail portions of adjacent contacts in each row alternating between extending from said body portion of said contact and said second portion of said mounting arms, such that rows of alternatingly-positioned tails extend from each row of contacts.

20. The contact of claim 1 wherein two mounting arms extend from said body portion and sandwich said tine, each of said arms being separated from said tine by a bifurcating slot and each of said arms having a retaining corner on an edge thereof facing away from said tine, said contact having an elongated integral tail portion extending in a direction opposite to said given direction from one of said two mounting arms.

21. The contact of claim 20 further including an insulator housing having a cavity in which the contact is mounted, said cavity having two facing surfaces, said retaining corners of said mounting arms forcibly pressing against said facing surfaces.

22. A contact of the type comprising a metal member including a body portion and at least two elongated cantilevered tines for making a primary contact, said tines extending generally in a given direction, each having a convex mating surface facing (a) in a direction perpendicular to said given direction and (b) the convex mating surface of the other contact, said tines each being springy and able to flex in a plane aligned in said direction perpendicular to said given direction, characterized in that (1) each of said tines is connected to said body portion by a respective common leg, and (2) a mounting arm is connected to the end of each common leg distal from said body portion, each mounting arm extending generally in said given direction, being separated from its respective tine by a bifurcating slot, and having a retaining edge facing in said direction perpendicular to said given direction, said retaining edge having at least one corner thereon for engaging the wall of an insulator housing, at least a portion of each mounting arm being positioned (a) under at least a portion of its respective tine, when viewed in a direction opposite to said given direction, and (b) in the same height area, measured in said given direction, as the portion of said tine adjacent its respective common leg, whereby the dimensions of said contact in said given direction and in said direction perpendicular to said given direction will be minimized and the beam length of said tine will be optimized.

23. The contact of claim 22 wherein a portion of each of said tines is in contact with a corresponding portion of the other tine, said mounting arms sandwiching the contacting portions of said tines.

* * * * *